United States Patent [19]

Raber

[11] 4,189,152

[45] Feb. 19, 1980

[54] GOLF LINK

[76] Inventor: John C. Raber, P.O. Box 356, Bristol, Ind. 46507

[21] Appl. No.: 677,695

[22] Filed: Apr. 16, 1976

[51] Int. Cl.[2] ..... A63B 69/36

[52] U.S. Cl. ..... 273/176 AB; 273/176 E; 273/176 B

[58] Field of Search ..... 273/176 R, 176 A, 176 AA, 273/176 AB, 178 B, 34 R, 34 A, 34 B

[56] References Cited

PUBLICATIONS

"Golf World," Jul. 20, 1962, p. 15.

*Primary Examiner*—George J. Marlo

*Attorney, Agent, or Firm*—Oltsch, Knoblock & Hall

[57] ABSTRACT

A golf link having a generally rectangular playing area and including two greens located at opposite ends of the playing area. Each green includes two holes. Four tee areas are located within the playing area with each tee area being positioned adjacent one corner of the playing area so as to enable a golfer to hit onto the green at the opposite end of the playing area and to play one of the two holes of the green.

7 Claims, 1 Drawing Figure

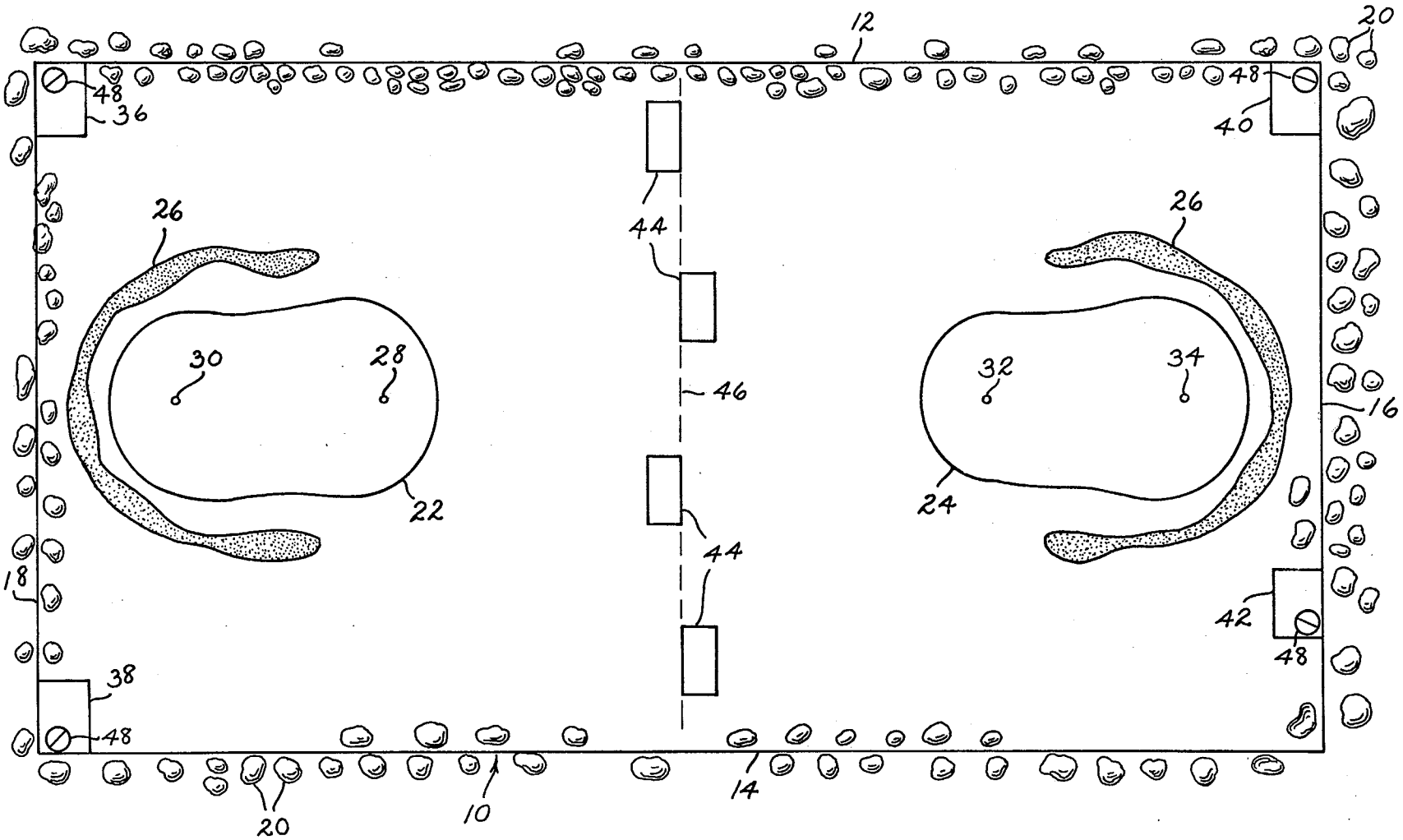
20
16
48
40
48
42
26
34
32
24
12
14
46
44
44
10
22
28
30
26
20
48
36
38
48
18

GOLF LINK

SUMMARY OF THE INVENTION

This invention relates to a golf link and will have a particular application to the golf link which can be incorporated into a limited geographical playing area.

In this invention the golf link includes a playing area formed into a generally rectangular configuration and having two side and two end boundaries. Two greens are oppositely located within the playing area with each green being positioned adjacent to one of the end boundaries. Each of the greens includes two playing holes. A tee area is located adjacent each corner of the playing area. From any one of the tee areas, a golfer may hit toward the green at the opposite end of the playing area for a selected one of the holes placed in the green. The golf link of this invention, which may include a practice putting green, parking area for cars, and a storage and golf shop area, can be constructed upon a ten acre plot of ground which frequently exists in many sections of the country near residential areas. At least four groups of players may utilize the link at one time. In this manner an attractive and challenging multiple three or four par course can be constructed upon limited acreage ground.

Accordingly, an object of this invention is to provide a golf link which can be constructed upon limited acreage ground.

Another object of this invention is to provide a multiple three or four par golf link.

Still another object of this invention it to provide a golf link which requires only a limited geographical area which can be economically constructed.

Other objects of this invention will become apparent upon a reading of the invention's description.

BRIEF DESCRIPTION OF THE DRAWING

The drawing is a plan view of one embodiment of the golf link of this invention.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

The golf link of this invention as depicted in the drawing includes a playing area 10 having side boundaries 12 and 14 and end boundaries 16 and 18 which depending upon the location and terrain of the link may be lined with trees 20. Playing area 10 is preferably of a rectangular configuration and includes two greens 22 and 24. Green 22 is located next to end boundary 18 and approximately midway between side boundaries 12 and 14. Green 24 is positioned next to end boundary 16 and is located approximately midway between side boundaries 12 and 14. A horseshoe-shaped sandtrap 16 extends about the rear half of each green. Green 22 includes two holes 28 and 30 with the placement of hole 28 being located near the front of the green and the placement of hole 30 being located near the rear of the green. Green 24 includes two holes 32 and 34 with hole 32 being placed near the front of the green and hole 34 being placed near the rear of the green. Playing area 10 also includes four tee areas 36, 38, 40 and 42. Tee area 36 is located at the junction of boundaries 12 and 18. Tee area 38 is located at the junction of boundaries 14 and 18. Tee area 40 is located at the junction of boundaries 12 and 16, and tee area 42 is located along boundary 16 near but spaced from side boundary 14.

To utilize the golf link above described, a player can start at any one of the tee areas 36-42. Assuming that the golfer starts at tee area 36, he tees off directing his ball toward green 24 and hole 34 on the green. After holing out at hole 34, the golfer can then proceed to tee area 40 where he tees off directing his ball to green 22 and hole 28 on the green. After holing out on hole 28, the golfer would then proceed to tee area 38 where he would tee off toward green 24 with the intention of playing hole 32 on the green. After holing out on hole 32, the golfer would then proceed to tee area 42 where he would tee off toward green 22 with the intention of playing hole 30 on the green. A par would be developed for each hole 28–34 with the golfer keeping score as in an ordinary golf game. The order of use of tee areas 36–42 can vary from game to game. Additionally the particular hole the golfer shoots for on the distant green from any one of the tee areas can also vary. With these variations, selected pars for the link can be determined. Boundaries 12–18 can be marked by flags, stakes, or similar means which serve as out-of-bounds designations. If a ball is hit out of bounds, the golfer must set in and lose one or more strokes. By utilizing due care and golfing courtesy, four foursomes can play the golf links simultaneously.

To vary the playing upon the golf area, one or more tee areas 44 can be positioned across playing area 10 between side boundaries 12 and 14 along a locating line 46 spaced between end boundaries 16 and 18. Tee areas 44 allow the golfer to shoot for greens 22 and 24 at a much shorter distance. It is contemplated that the distance between end boundaries 16 and 18 may be 220 yards while the distance between side boundaries 12 and 14 may be 120 yards with each green 22 and 24 having an overall dimension of 90 feet by 120 feet. Day to day placement of holes 28–34 upon greens 22 and 24 can also be changed.

When two to four foursomes play the links simultaneously, a visible warning device 48, such as a flag, is placed upon or near each tee area 36–42. Each foursome displays the warning device 48 at their tee area until all have teed off. After all members of the foursome have hit, the warning device at the tee area is rendered inoperative either by covering, lowering or removal, with the members remaining at the tee area until each warning device at the remaining tee areas is also rendered inoperative. When this occurs all foursomes have teed off and now may leave their respective tee areas to advance to their balls for their next shots. In this manner no golfer will venture into the line of shot of another golfer teeing off. Should a shot from a tee area 36–42 be dubbed and not pass locating line 46, the player will move his ball to the nearest tee area 44, lose one stroke, and proceed to tee off from the tee area to the green. Once all golfers have holed out, the foursomes will move to another tee area 36–42 where each warning device 48 will be displayed until all have teed off toward another green.

From construction to construction of the golf link of this invention, the precise shape of the greens as well as the placement of the tee areas at the respective corners of the playing area may vary. Also additional hazards and a variation of location of the sandtraps may be utilized.

It is to be understood that the invention is not to be limited to the details above given but may be modified within the scope of the appended claims.

What I claim is:

1. A golf link comprising a playing area having two side boundaries and two end boundaries, first and second spaced greens within said playing area, said first green being located adjacent one end boundary and said second green being located adjacent the other end boundary, each green having at least first and second spaced holes, a first tee area located adjacent said one end boundary and between said one side boundary and first green from which a golfer may hit to said second green and one hole thereof, a second tee area located adjacent said one end boundary and between the other side boundary and first green from which a golfer may hit to said second green and the other hole thereof, a third tee area located adjacent said other end boundary and between said one side boundary and second green from which a golfer may hit to said first green and one hole thereof, and a fourth tee area located adjacent to said other end boundary and between said other side boundary and second green from which a golfer may hit to said first green and the other hole thereof, all said tee areas being located within said playing area.

2. The golf link of claim 1 wherein said playing area is generally rectangular shaped having four corners each defined by the intersection of a said side boundary and end boundary, a tee area located adjacent each corner.

3. The golf link of claim 2 wherein at least two of said tee areas is located within a said corner.

4. The golf link of claim 2 wherein said playing area between said first and second greens includes at least two additional tee areas each located between said side boundaries from which a golfer may hit to either of said first or second greens.

5. The golf link of claim 2 and a sandtrap located in the playing area between the said first green and one end boundary.

6. The golf link of claim 5 and another sand trap located in said playing area between said second green and other end boundary.

7. The golf link of claim 1 and member means at each tee area for indicating that a golfer has hit from the tee area.

* * * * *